US008144916B2

(12) United States Patent
Zhang

(10) Patent No.: US 8,144,916 B2
(45) Date of Patent: Mar. 27, 2012

(54) VIBRATING SYSTEM OF PANEL FORM ELECTRODYNAMIC LOUDSPEAKER

(76) Inventor: Bailiang Zhang, GuangZhou (CN)

( * ) Notice: Subject to any disclaimer, the term of this patent is extended or adjusted under 35 U.S.C. 154(b) by 606 days.

(21) Appl. No.: 12/438,991

(22) PCT Filed: Sep. 27, 2007

(86) PCT No.: PCT/CN2007/002827

§ 371 (c)(1),
(2), (4) Date: Feb. 26, 2009

(87) PCT Pub. No.: WO2008/043260

PCT Pub. Date: Apr. 17, 2008

(65) Prior Publication Data

US 2009/0262961 A1 Oct. 22, 2009

(30) Foreign Application Priority Data

Sep. 27, 2006 (CN) ..... 2006 1 0122444
Aug. 21, 2007 (CN) ..... 2007 1 0029826

(51) Int. Cl.
*H04R 1/00* (2006.01)

(52) U.S. Cl. ..... 381/398

(58) Field of Classification Search ..... None
See application file for complete search history.

(56) References Cited

U.S. PATENT DOCUMENTS 4,635,750 A 1/1987 Suzuki
6,188,774 B1 2/2001 Sabato et al.
6,236,733 B1 * 5/2001 Kato et al. ..... 381/423
6,305,491 B2 10/2001 Iwasa et al.
7,545,948 B2 * 6/2009 Fradin ..... 381/394
7,916,878 B2 * 3/2011 Bank et al. ..... 381/152
2001/0011615 A1 8/2001 Iwasa et al.
2003/0123692 A1 * 7/2003 Ueki ..... 381/398
2006/0153420 A1 7/2006 Takase et al.

FOREIGN PATENT DOCUMENTS

CA 2177400 11/1997
CN 1235504 A 11/1999

(Continued)

OTHER PUBLICATIONS

International search Report (PCT/ISA/210) dated Dec. 26, 2007.

*Primary Examiner* — Charles Garber
*Assistant Examiner* — Andre' C Stevenson
(74) *Attorney, Agent, or Firm* — Buchanan Ingersoll & Rooney PC

(57) ABSTRACT

The present invention discloses a vibrating system of flat-plate electrodynamic loudspeaker, which comprises a flat-plate vibrating plate and a voice coil mounted under the vibrating plate. The vibrating system is characterized in that the thickness of the vibrating plate within the voice coil is not more than ½ of that of the vibrating plate outside the voice coil. Alternatively, the vibrating plate within the voice coil can be replaced by a vibrating diaphragm. The thin plate within the voice coil according to the present invention can provide compensation for high frequency response, widen frequency band, and reduce the overall height of voice coil and vibrating plate. According to the present invention, a thin flat-plate loudspeaker that almost cover the full audio frequency bands can be designed, thereby producing a thin flat-plate full frequency speaker system to meet the demand of market.

20 Claims, 6 Drawing Sheets

FOREIGN PATENT DOCUMENTS

| | | | |
|---|---|---|---|
| CN | 1242921 | A | 1/2000 |
| CN | 1264266 | A | 8/2000 |
| CN | 2490781 | Y | 5/2002 |
| CN | 1723737 | A | 1/2006 |
| CN | 2751498 | Y | 1/2006 |
| CN | 1794883 | A | 6/2006 |
| JP | 61-123398 | A | 6/1986 |
| JP | 5-88091 | A | 4/1993 |
| JP | 2002-125290 | A | 4/2002 |
| WO | WO 2005/112505 | A1 | 11/2005 |

* cited by examiner

VIBRATING SYSTEM OF PANEL FORM ELECTRODYNAMIC LOUDSPEAKER

FIELD OF THE INVENTION

The present invention relates to an improved vibrating system of flat-panel electrodynamic loudspeaker.

BACKGROUND OF THE INVENTION

Presently, as flat-panel TV is thriving, the demand of flat-panel or thin-type speaker system in match with the flat-panel TV is increasing significantly. There are three categories of such speaker system. One category is extra-thin speaker system designed according to bending-panel-vibrating principle disclosed in NXT (U.K.) patent, the second one being thin-type speaker system manufactured by using the common cone loudspeaker, and the third one being flat-panel speaker system manufactured by using conventional flat-panel loudspeaker.

Among them, the flat-panel loudspeaker has a long history and there has been some new development thereof, such as BES patent, multi-drive technology, coaxial flat-panel loudspeaker technology etc. However, these newly developed technologies have their own problem that the upper limit of the high frequency band can not extend to cover the full audio frequency range, and the flat-panel loudspeaker has a comparably large thickness, high cost of production, difficulty in its manufacture process.

As for the NXT's patent technology, there remain two problems. The first problem is that it cannot cover full frequency range, and thus subwoofer speaker system should be needed additionally for frequency below 200 Hz. The second problem is that in the high frequency range, the sound pressure response is not flat while a flat power response can be achieved. It means that the loudspeaker has a non-flat transient frequency response and a flat long-time average response, which shall lead to bad listening.

The thin type speaker system designed with conventional loudspeakers has firstly large thickness, which may be over 6 cm in general, thus hard to match with the flat-panel TV, and secondly has a heavy weight, hard to be hang on the wall.

Clearly there exists a demand for a thin type full-range flat-panel loudspeaker, which could cover all the audio range.

SUMMARY OF THE INVENTION

The object of the present invention is to meet the demand of market by providing a new structure of vibrating system of flat-panel electrodynamic loudspeaker, thereby achieving a thin flat-panel loudspeaker capable of covering the whole audio frequency range and manufacturing a thin flat-panel full-frequency-range speaker system.

The vibrating system of flat-panel electrodynamic loudspeaker according to the present invention comprises a flat-panel vibrating plate and a voice coil mounted under the vibrating plate. The vibrating system is characterized in that the vibrating plate within the voice coil has a thickness not more than ½ of thickness of the vibrating plate outside the voice coil.

In order to achieve a good compensation effect in high frequency range, a preferred design is to let the vibrating plate within the voice coil have a thickness not more than 3 mm.

Further preferably, the vibrating plate within the voice coil can be replaced by vibrating diaphragm, and this vibrating diaphragm may be a planar vibrating diaphragm, or a curved-surface vibrating diaphragm, such as a dome type diaphragm of a conventional tweeter loudspeaker.

In the vibrating system of loudspeaker according to the present invention, there is a thick vibrating plate outside the voice coil and a thin vibrating plate within the voice coil, wherein the thickness of the plate within the voice coil is significantly less than that of the plate outside the voice coil. According to the concept of the present invention, the flat-panel vibrating plate and the voice coil mounted under the vibrating plate can be structured as below: A circular recess or circular through hole is formed in the vibrating plate at place where the voice coil is to be mounted. In case of the circular recess, a thin plate (with a thickness not more than ½ of that of the whole vibrating plate) formed at the bottom of the recess functions as the vibrating plate within the voice coil. In case of the circular through hole, said vibrating diaphragm will be used to cover the circular through hole. The voice coil is attached firmly to the side wall of the recess or the through hole. Thus, the contact area between the voice coil and the vibrating plate will be increased significantly. According to prior art, only a ring on top of the voice coil contacts with the vibrating plate, which may be referred as 'line contact'. However, in the present invention, it is a section of cylindrical surface with certain height that contacts with the vibrating plate, and thus may be referred as 'area contact'. The present invention has a much larger contact area than the prior art, thus the contact strength can be significantly enhanced, thereby decreasing the overall height of the voice coil and the vibrating plate.

For a square vibrating plate adopting multi-drive scheme and small-sized circular vibrating plate, the above technique may be applied directly due to their voice coils having small diameter.

For a vibrating system of flat-panel electrodynamic loudspeaker with circular vibrating plate of larger size, the conventional design uses a voice coil having the nodal diameter of the first-order resonance mode of the vibrating plate (about 0.68-0.7 times the diameter of the vibrating plate) as the drive, which may be referred as "single-drive". If a thin vibrating plate is adopted in a voice coil with such a big size, a problem of insufficient strength may arise. To overcome this problem, a solution with multi-drive by a plurality of voice coils may be adopted. In this solution, when said vibrating plate is a round plate with a diameter not less than 8 cm, a plurality of voice coils of small size, radius of each of which is not more than the nodal radius of the first-order resonance mode of the vibrating plate, will be distributed on the nodal circle of the first-order resonance mode of the whole vibrating plate. In this way, thin vibrating plates provided within these small size voice coils can offer compensation for high frequency, and avoid the problem regarding strength in case of the wide-area thin plate.

A further improvement is provided based on the above technical solution. A circular through hole is formed in the vibrating plate at place where a voice coil is to be mounted. To side wall of the through hole is attached firmly the voice coil, at the top of which a vibrating diaphragm integrating with the bobbin of the voice coil is provided. The vibrating diaphragm may be any forms of conventional dome diaphragm, such as flat-topped, convex or concave-topped diaphragm. It is preferred that the vibrating diaphragm at the top of the voice coil should inosculate or be flush with the top of the vibrating plate when assembling.

The vibrating diaphragm at the top of the voice coil may integrate with the bobbin of the voice coil. The bobbin of the voice coil may be a roofed cylinder, such as an aluminum roofed cylinder. The top roof surface of the cylinder functions as a diaphragm, and lower section of the cylinder is wound with coils, thereby forming an integral diaphragm and voice coil.

The above improvement may fit also for the case of multi-driving with a plurality of voice coils. In this case, the panel vibrating plate has one or more through holes. On at least one of the through holes is mounted a voice coil, at the top of which vibrating diaphragm and the bobbin are integrated.

In the above solution, the integral vibrating diaphragm and the voice coil are combined with the vibrating plate having through hole(s), so that the top of the aluminum cylinder inosculates or is flush with the top of the vibrating plate. In this way, not only the assembly is simplified, but also the bonding between the vibrating diaphragm and the voice coil is made to be firm, thus further improving high frequency response and ensuring consistency of performance of the loudspeakers. In the case of an aluminum roofed cylinder being used, the aluminum integral diaphragm at the top of the cylinder can greatly improve heat elimination effect of the voice coil and thus improve the ability of power handing of the loudspeaker.

The present invention may be applied to driving with a plurality of voice coils, to reduce assembling difficulty and improve homogeneity of products.

The important technical characteristics and the important technical effect therefrom according to the present invention is that the part of thin vibrating plate within the voice coil contributes to a major portion of high frequency sound produced by the whole vibrating plate. Thus, the sound is produced by the whole vibrating plate in low and middle frequency range, but when moving to high frequency range, the sound is gradually produced mainly by the thin section of the vibrating plate within the voice coil driven directly by the voice coils. The present invention introduces a compensation part for high frequency into the flat-panel vibrating plate, thereby achieving an effect similar to the "coaxial" loudspeaker. Furthermore, the present invention solves the problem as to how to get reasonable amplitude in a space with limited thickness, because the reduced thickness of vibrating plate within the voice coil provides room for the up-down movement of the vibrating system.

BRIEF DESCRIPTION OF THE DRAWINGS

FIGS. 2 and 3 are schematic diagrams of a vibrating system of single-drive flat-panel loudspeaker, in which the vibrating plate within voice coil is a vibrating diaphragm, according to the present invention, wherein FIG. 2 is its front view and FIG. 3 is its top view;

FIGS. 4 and 5 are schematic diagrams of a first vibrating system of multi-drive flat-panel loudspeaker according to the present invention, wherein FIG. 4 is a front view and FIG. 5 is a top view;

FIGS. 6 and 7 are schematic diagrams of a second vibrating system of multi-drive flat-panel loudspeaker according to the present invention, wherein FIG. 6 is a front view and FIG. 7 is a top view;

FIGS. 8 and 9 are schematic diagrams of a third vibrating system of multi-drive flat-panel loudspeaker according to the present invention, wherein FIG. 8 is a front view and FIG. 9 is a top view;

FIGS. 10 and 11 are two schematic diagrams of a fourth vibrating system of multi-drive flat-panel loudspeaker according to the present invention, wherein FIG. 10 is a front view and FIG. 11 is a top view.

DETAILED DESCRIPTION OF THE INVENTION

Embodiment 1

Figure 1:
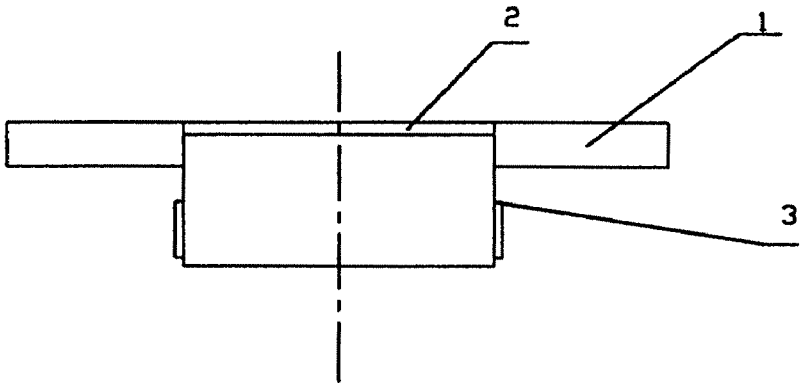
FIG. 1 is a schematic diagram of a vibrating system of single-drive flat-panel loudspeaker according to the present invention.

In this embodiment, there is provided a vibrating system of a single-drive flat-panel loudspeaker. As shown in FIG. 1, a vibrating plate 1 of the vibrating system is made of lightweight foam plate with ϕ5 cm and 0.5 cm thick, on which a voice coil 3 with ϕ2.8 cm is mounted. The vibrating plate 2 in the voice coil is reduced in thickness to 0.1 cm to compensate for high frequency response. A circular recess is formed in the vibrating plate at place where the voice coil is to be mounted, and the voice coil 3 is attached to the side wall of the recess.

Embodiment 2

Figure 2:
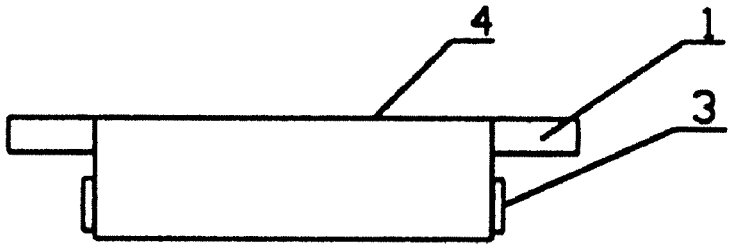
Figure 3:
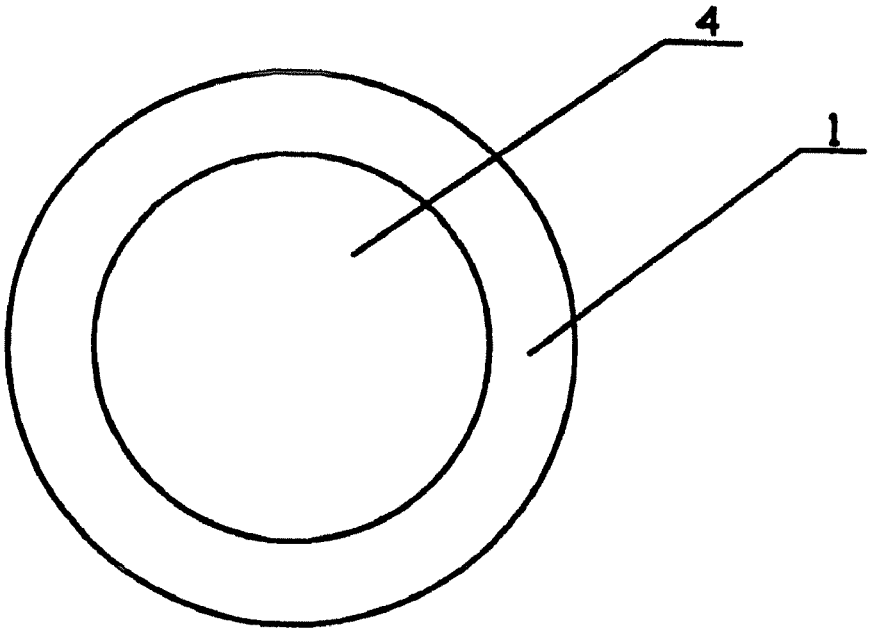

In this embodiment, there is provided another vibrating system of single-drive flat-panel loudspeaker. As shown in FIGS. 2 and 3, a vibrating plate 1 of the vibrating system is made of lightweight foam plate with ϕ5 cm and 0.5 cm thick, on which a voice coil 3 with ϕ2.8 cm is mounted. The vibrating plate within the voice coil is replaced by a vibrating diaphragm 4. A circular through hole is provided in the vibrating plate at place where the voice coil is to be mounted and the hole reaches the top of the vibrating plate. There is a planar vibrating diaphragm 4 covering the top of the circular through hole. The voice coil 3 is attached to the inner side wall of the through hole. The bobbin of the voice coil extends to the top of the vibrating plate 1 and is connected to the vibrating diaphragm 4.

Embodiment 3

Figure 4:
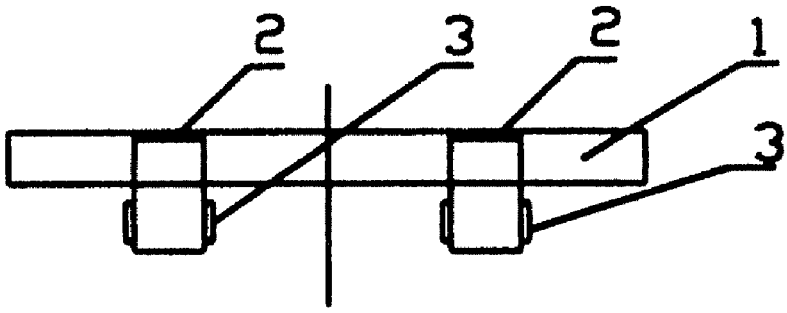
Figure 5:
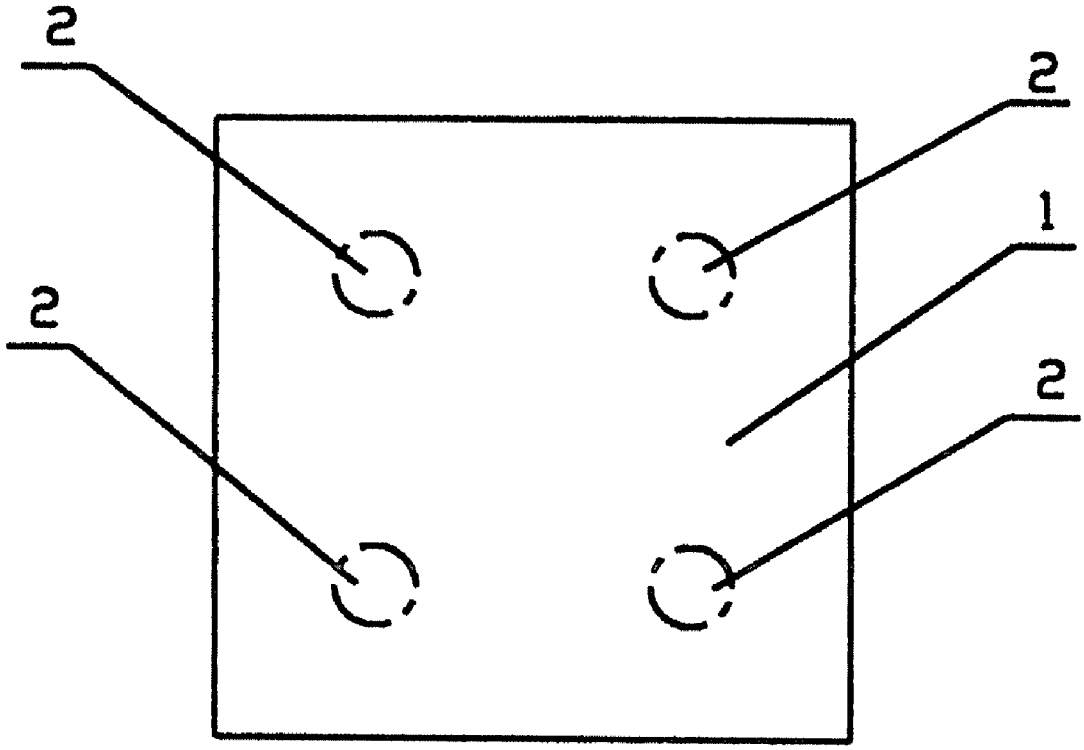

In this embodiment, there is provided a vibrating system of multi-drive flat-panel loudspeaker with a square flat-panel vibrating plate. As shown in FIGS. 4 and 5, a vibrating plate 1 is made of lightweight foam plate with 10×10×1 cm (L×W×H). At the nodal line of the first-order resonance mode of the vibrating plate, i.e. at 4 off-center positions, four voice coils 3 with 2.5 cm are mounted. Circular recesses matching in size with the voice coils are formed in advance at respective positions where each of the voice coils will be mounted, and thin vibrating plates 2 with thickness of 2 mm are formed at the top of the recesses. The voice coils 3 can be inserted exactly into the recesses and attached to the vibrating plate well by adhesion using glue. Thus, the thin plate within the voice coil can provide compensation for high frequency response, thereby extending the frequency band.

Embodiment 4

Figure 6:
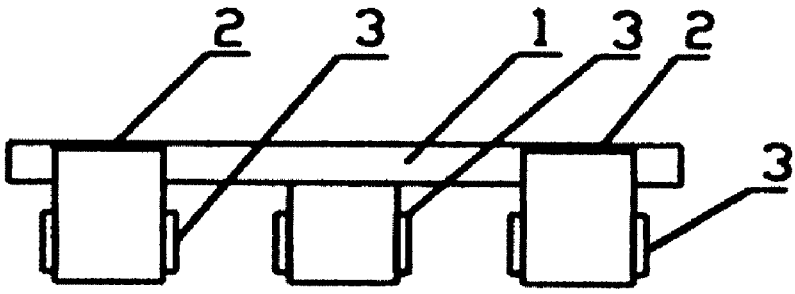
Figure 7:
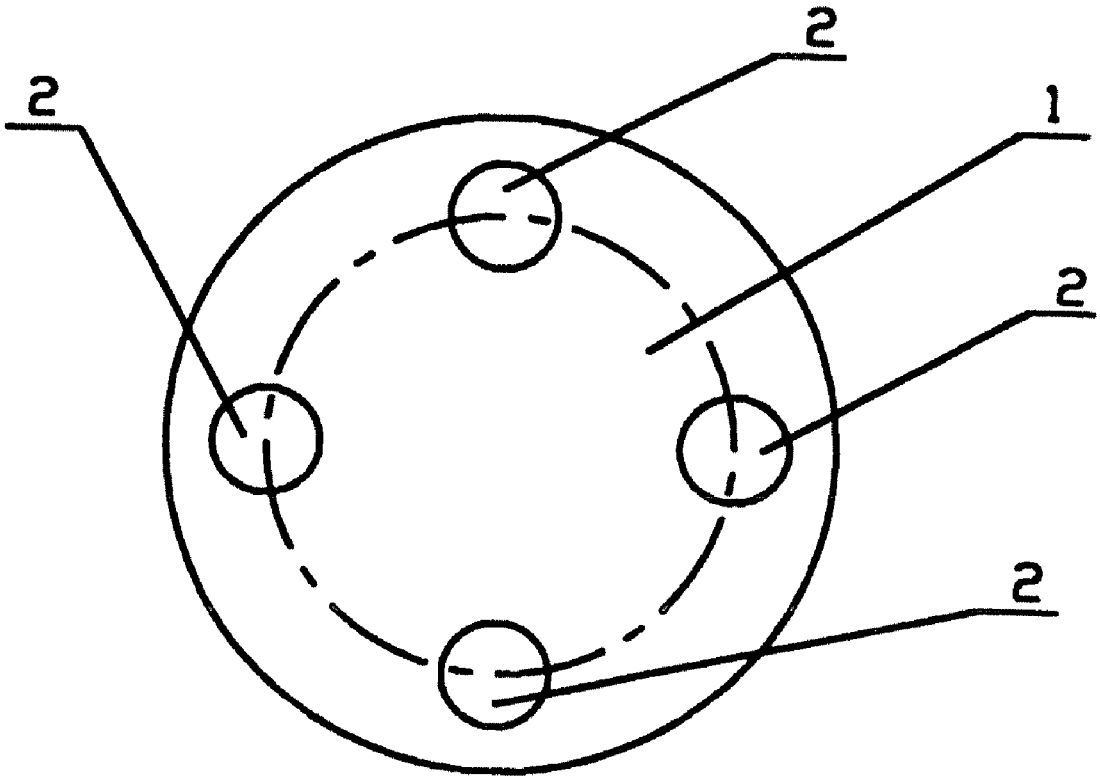

In this embodiment, there is provided a vibrating system of multi-drive flat-panel loudspeaker with a circular flat-panel vibrating plate. As shown in FIGS. 6 and 7, the vibrating plate 1 is made of lightweight foam plate with ϕ11 cm and with thickness of 1 cm, and 4 voice coils are distributed uniformly on the nodal circle of the first-order resonance mode of the vibrating plate (having a diameter about ϕ7-8 cm, and could be determined by experiment). The vibrating plate 2 within the voice coil is 0.2 cm thick, thereby compensating for high frequency response.

Embodiment 5

Figure 8:
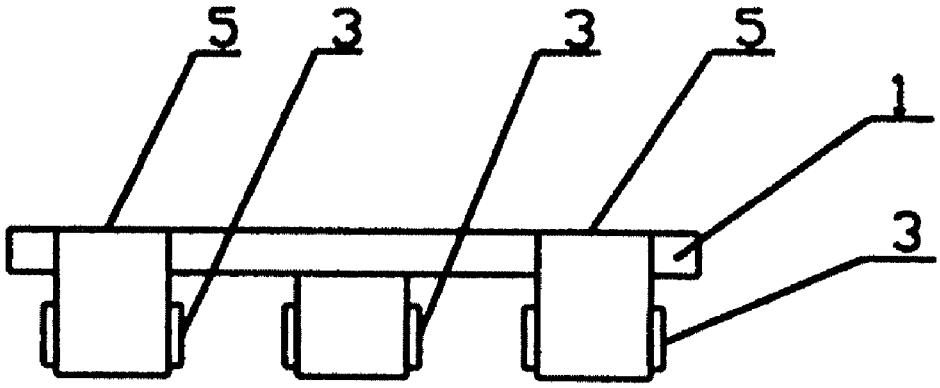
Figure 9:
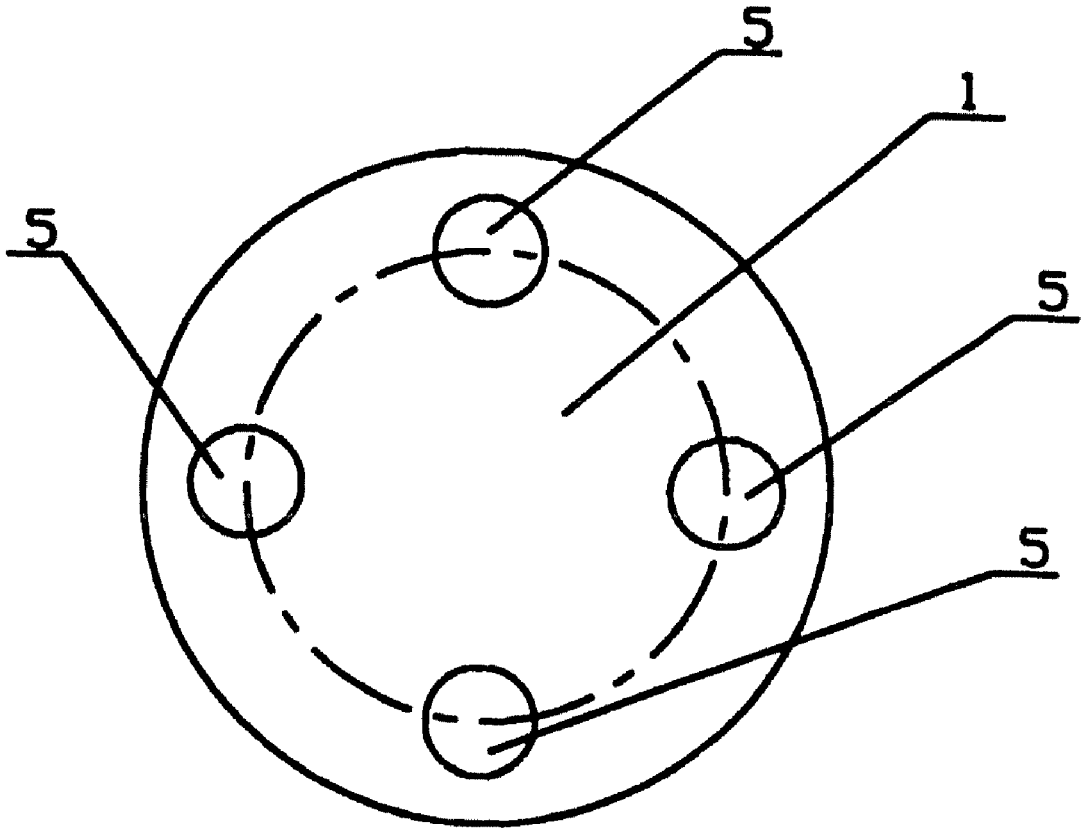

In this embodiment, there is provided a vibrating system of multi-drive flat-panel loudspeaker with a circular flat-panel vibrating plate. As shown in FIGS. 8 and 9, the vibrating plate 1 is made of lightweight foam plate with ϕ11 cm and with thickness of 1 cm. Four circular holes, each with ϕ2.5 cm, are provided uniformly on the nodal circle of the first-order resonance mode (about ϕ7-8 cm). Four voice coils 3, each with ϕ2.5 cm, are respectively mounted in the through holes. The bobbins of the voice coils extend to the top of the vibrating plate. The upper surface of the vibrating plate is covered by a vibrating diaphragm made of fabric so that a close connection is formed between the fabric and the vibrating plate 1 and the voice coils. Thus, a vibrating diaphragm 5 made of fabric is formed on the voice coils 3. In this way, the sound in the high frequency range is produced mainly by the 4 vibrating diaphragms with ϕ2.5 cm driven directly by the voice coils, thereby compensating for high frequency response effectively.

Embodiment 6

Figure 10:
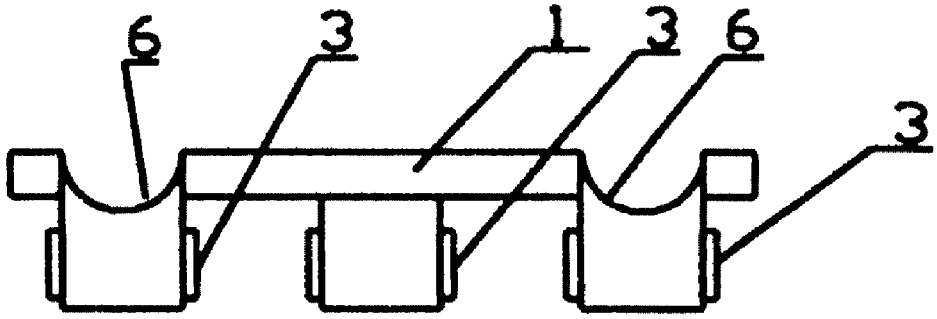
Figure 11:
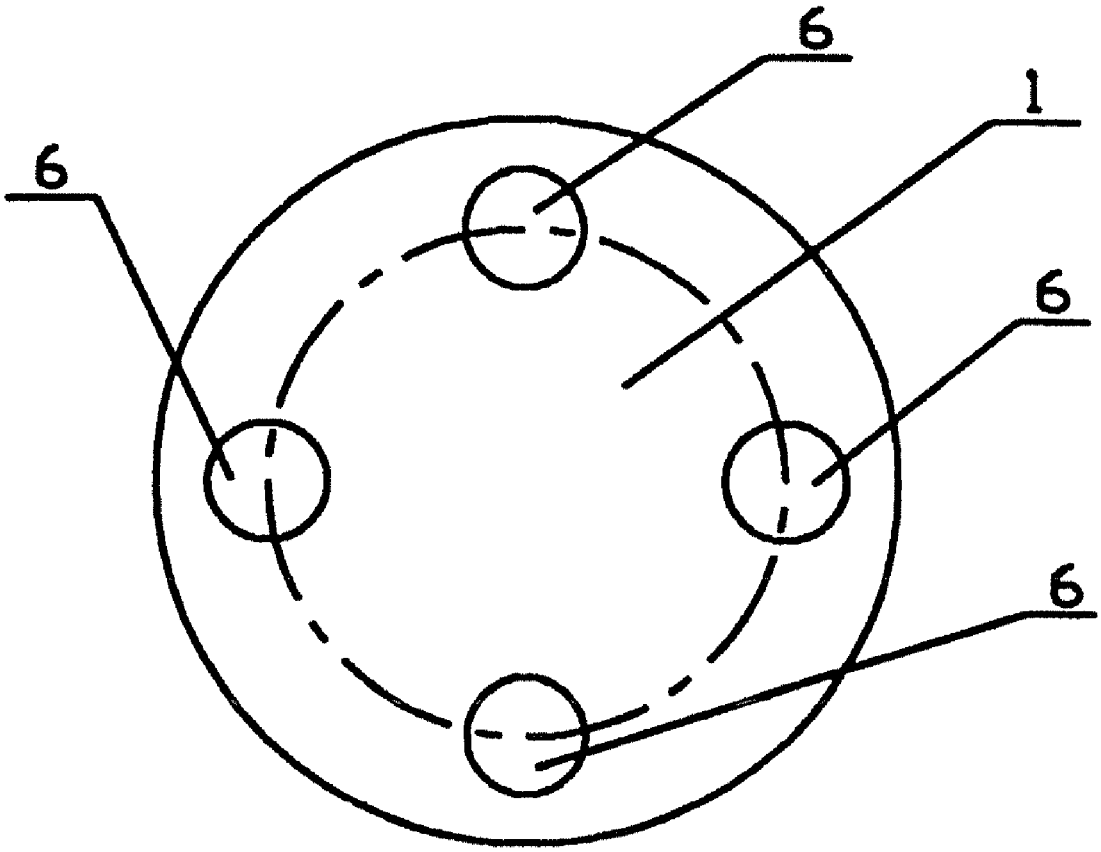

In the embodiment, there is provided a vibrating system of multi-drive flat-panel loudspeaker with circular flat-panel vibrating plate. As shown in FIGS. 10 and 11, the vibrating plate 1 is made of lightweight foam plate with ϕ11 cm and with thickness of 1 cm. Four ϕ2.5 cm circular holes are provided uniformly on the nodal circle of the first-order resonance mode of the vibrating plate (a circle with about ϕ7-8 cm), and then 4 voice coils 3 with ϕ2.5 cm are mounted in these holes, with their bobbins extending to the top of the vibrating plate. Further, a concave dome tweeter diaphragm 6 is provided on each of the voice coils 3, so as to compensate for high frequency response.

Embodiment 7

Figure 12:
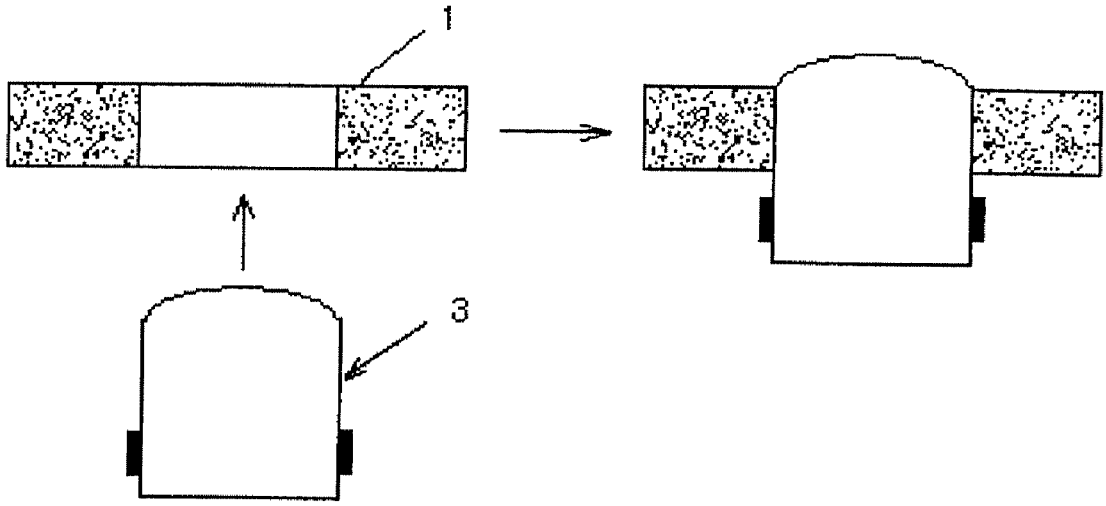
FIG. 12 is a schematic diagram of an exploded view of an improved vibrating system of flat-panel loudspeaker according to the present invention.

In this embodiment, there is provided an improved vibrating system of single-drive flat-panel vibrating plate. As shown in FIG. 12, the vibrating plate 1 of the system is made of a lightweight foam plate with ϕ5 cm and with thickness of 0.5 cm. An improved voice coil 3 with ϕ2.8 cm is attached firmly to the vibrating plate. The voice coil 3 has an aluminum roofed cylinder, with the roof functioning as a vibrating diaphragm (i.e., an aluminum diaphragm). At lower portion of the cylinder is wound with coil, thereby forming an integrated vibrating diaphragm and voice coil. The voice coil 3 is attached firmly to side wall of the circular through hole in the center of the vibrating plate 1. The top of the aluminum cylinder inosculates the top of the vibrating plate.

What is claimed is:

1. A vibrating system of a flat-panel electrodynamic loudspeaker, comprising: a flat-panel vibrating plate and a voice coil mounted under the vibrating plate, wherein a thickness of the vibrating plate where the voice coil is mounted is not more than ½ of the thickness of the vibrating plate outside the voice coil.

2. The vibrating system of flat-panel electrodynamic loudspeaker according to claim 1, wherein the thickness of the vibrating plate where the voice coil is mounted is not more than 3 mm.

3. The vibrating system of flat-panel electrodynamic loudspeaker according to claim 1, wherein the vibrating plate wherein the voice coil is mounted is a vibrating diaphragm.

4. The vibrating system of flat-panel electrodynamic loudspeaker according to claim 3, wherein the said vibrating diaphragm is a planar diaphragm or a curved surface diaphragm.

5. The vibrating system of flat-panel electrodynamic loudspeaker according to claim 1, wherein a circular recess or a circular through hole is formed in the vibrating plate at the position where the voice coil is mounted, wherein the voice coil is attached firmly to a side wall of the recess or the through hole.

6. The vibrating system of flat-panel electrodynamic loudspeaker according to claim 1, wherein a circular through hole is formed in the vibrating plate at a place where the voice coil is mounted, wherein the voice coil is attached to a side wall of the through hole, and the vibrating plate and a bobbin of the voice coil form an integrated member.

7. The vibrating system of flat-panel electrodynamic loudspeaker according to claim 6, wherein the vibrating plate where the voice coil is mounted is a vibrating diaphragm positioned at a top of the bobbin of the voice coil.

8. The vibrating system of flat-panel electrodynamic loudspeaker according to claim 7, wherein the vibrating diaphragm positioned at the top of the bobbin of the voice coil inosculates or is flush with the top of the vibrating plate outside the voice coil.

9. The vibrating system of flat-panel electrodynamic loudspeaker according to claim 7, wherein the bobbin of the voice coil is an aluminum roofed cylinder, with a roof forming the vibrating diaphragm directly.

10. The vibrating system of flat-panel electrodynamic loudspeaker according to claim 1, wherein the vibrating plate is circular and not less than 8 cm in diameter, and a plurality of voice coils of small size, each of which voice coil has a radius not more than a nodal radius of the first-order resonance mode of the whole vibrating plate, are distributed on the nodal circle of the first-order resonance mode.

11. The vibrating system of flat-panel electrodynamic loudspeaker according to claim 6, wherein the flat-panel vibrating plate has one or more through holes, at least in one of which the voice coil is mounted, wherein the vibrating plate at the top of the voice coil and the bobbin of the voice coil are integrated.

12. The vibrating system of flat-panel electrodynamic loudspeaker according to claim 2, wherein a circular recess or a circular through hole is formed in the vibrating plate at position where the voice coil is mounted, wherein the voice coil is attached firmly to the side wall of the recess or the through hole.

13. The vibrating system of flat-panel electrodynamic loudspeaker according to claim 3, wherein a circular recess or a circular through hole is formed in the vibrating plate at position where the voice coil is mounted, wherein the voice coil is attached firmly to the side wall of the recess or the through hole.

14. The vibrating system of flat-panel electrodynamic loudspeaker according to claim 4, wherein a circular recess or a circular through hole is formed in the vibrating plate at position where the voice coil is mounted, wherein the voice coil is attached firmly to the side wall of the recess or the through hole.

15. The vibrating system of flat-panel electrodynamic loudspeaker according to claim 2, wherein a circular through hole is formed in the vibrating plate at a place where the voice coil is mounted, wherein the voice coil is attached to a side wall of the through hole, and the vibrating plate and a bobbin of the voice coil form an integrated member.

16. The vibrating system of flat-panel electrodynamic loudspeaker according to claim 3, wherein a circular through hole is formed in the vibrating plate at a place where the voice coil is mounted, wherein the voice coil is attached to a side wall of the through hole, and the vibrating plate and a bobbin of the voice coil form an integrated member.

17. The vibrating system of flat-panel electrodynamic loudspeaker according to claim 4, wherein a circular through hole is formed in the vibrating plate at a place where the voice coil is mounted, wherein the voice coil is attached to a side wall of the through hole, and the vibrating plate and a bobbin of the voice coil form an integrated member.

18. The vibrating system of flat-panel electrodynamic loudspeaker according to claim 2, wherein the vibrating plate is circular and not less than 8 cm in diameter, and a plurality of voice coils of small size, each of which voice coil has a radius not more than the nodal radius of the first-order resonance mode of the whole vibrating plate, are distributed on a nodal circle of the first-order resonance mode.

19. The vibrating system of flat-panel electrodynamic loudspeaker according to claim 3, wherein the vibrating plate is circular and not less than 8 cm in diameter, and a plurality of voice coils of small size, each of which voice coil has a radius not more than the nodal radius of the first-order resonance mode of the whole vibrating plate, are distributed on a nodal circle of the first-order resonance mode.

20. The vibrating system of flat-panel electrodynamic loudspeaker according to claim 4, wherein the vibrating plate is circular and not less than 8 cm in diameter, and a plurality of voice coils of small size, each of which voice coil has a radius not more than the nodal radius of the first-order resonance mode of the whole vibrating plate, are distributed on a nodal circle of the first-order resonance mode.

* * * * *